US009121102B2

(12) United States Patent
Pessetto et al.

(10) Patent No.: US 9,121,102 B2
(45) Date of Patent: Sep. 1, 2015

(54) PLATING APPARATUS

(75) Inventors: Craig Paul Pessetto, Syracuse, UT (US); Joshua James Ault, Clinton, UT (US); Kelly Vernal Smith, Tremonton, UT (US); Karl Henrie Robinson, Layton, UT (US)

(73) Assignee: ES3, Clearfield, UT (US)

( * ) Notice: Subject to any disclaimer, the term of this patent is extended or adjusted under 35 U.S.C. 154(b) by 398 days.

(21) Appl. No.: 13/533,886

(22) Filed: Jun. 26, 2012

(65) Prior Publication Data

US 2013/0341198 A1 Dec. 26, 2013

(51) Int. Cl.

| | |
|---|---|
| ***C25D 17/00*** | (2006.01) |
| ***C25D 17/10*** | (2006.01) |
| ***C23F 11/00*** | (2006.01) |
| ***C25D 5/04*** | (2006.01) |
| ***C25D 7/04*** | (2006.01) |

(52) U.S. Cl.
CPC . *C23F 11/00* (2013.01); *C25D 5/04* (2013.01); *C25D 7/04* (2013.01); *C25D 17/10* (2013.01)

(58) Field of Classification Search
USPC ..... 205/118, 246; 204/275.1
See application file for complete search history.

(56) References Cited

U.S. PATENT DOCUMENTS

| | | | | |
|---|---|---|---|---|
| 1,795,481 | A * | 3/1931 | Eaton | 205/210 |
| 2,323,952 | A * | 7/1943 | Wick | 204/287 |
| 2,760,929 | A * | 8/1956 | Shepard et al. | 204/242 |
| 3,644,182 | A * | 2/1972 | Wittel | 205/132 |
| 3,888,755 | A * | 6/1975 | Wallace | 204/272 |
| 2007/0063521 | A1 * | 3/2007 | Lancashire et al. | 293/102 |

OTHER PUBLICATIONS

Published drawings labeled 201125583 published Jun. 22, 2011, 9 sheets.

Published drawings labeled 201125580 published Jun. 20, 2011, 10 sheets.

* cited by examiner

*Primary Examiner* — Keith Hendricks
*Assistant Examiner* — Stefanie S Wittenberg
(74) *Attorney, Agent, or Firm* — Klaas, Law, O'Meara & Malkin PC; William P. O'Meara, Esq.

(57) ABSTRACT

A plating assembly for plating a part having an interior cavity with a plating material. The plating assembly has a main frame assembly adapted to receive and support the part. An anode frame assembly is positioned inside the main frame assembly and is electrically isolated from the main frame assembly. The anode frame assembly is electrically connected to an anode of a direct current power supply. A plurality of anode rods are mounted on the anode frame assembly in electrically conductive contact with it. A cathode assembly is electrically connected to the part and is electrically connected to a cathode of the direct current power supply. A fluid conduit assembly connects a fluid source such as a pump station to a plurality of fluid nozzles. At least one of the fluid nozzles is positioned within the interior cavity of the part.

12 Claims, 11 Drawing Sheets

PLATING APPARATUS

BACKGROUND

Low Hydrogen Embrittlement (LHE) Zinc-Nickel (Zn—Ni) plating is used as a sacrificial protective coating on high strength steel (HSS, i.e. steel alloys such as 300M, 4330, 4340, etc., with an ultimate tensile strength of 180 KSI or higher) landing gear alloys to prevent corrosion. The HSS alloys used in landing gear component applications corrode rapidly if exposed to the environment without sacrificial plating like LHE Zn—Ni. Therefore it is a design requirement that HSS alloys used in landing gear be protected from corrosion attack via sacrificial plating. The plating must also be porous enough to allow hydrogen to be baked out after the plating process is completed. LHE Zn—Ni has been developed over the past eight years and is an environmentally friendly and non-hydrogen embrittling replacement for cadmium. All non-wear surfaces, both internal and external, of HSS landing gear components must be LHE Zn—Ni plated to protect them from corrosion.

LHE Zn—Nil plating is typically performed by immersing the part to be coated in an electrolyte bath, such as Dipsol of America's, IZ-C17+, LHE Zn—Ni electrolyte plating solution. The part to be plated is electrically connected to the cathode of a direct current power source. A source of ionizing nickel is placed in the electrolyte bath and is electrically connected to the anode of the direct current power source.

DETAILED DESCRIPTION

Figure 1:
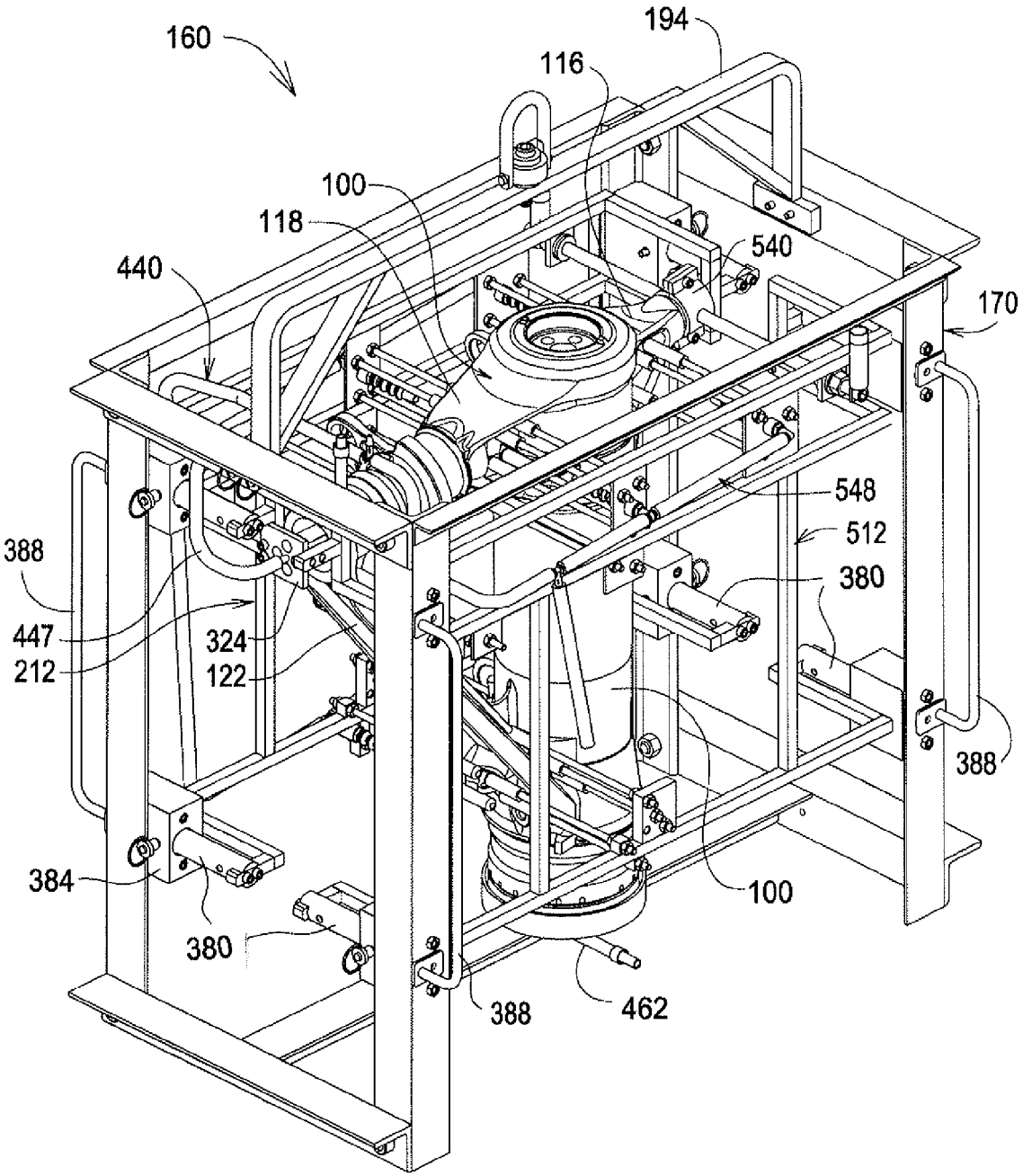
FIG. 1 is a right side isometric view of a cylinder assembly of an aircraft main landing gear and a plating assembly therefore.

In general this description discloses, as best shown in FIGS. 1-5, a plating assembly 160 for plating a part 100, having at least one interior cavity 105, with a plating material such as nickel or Zn—Ni. The plating assembly 160 comprises a main frame assembly 170 adapted to receive and support the part 100 therein. An anode frame assembly 212, 512 is positioned inside the main frame assembly 170 and is electrically isolated from the main frame assembly. The anode frame assembly 212, 512 is electrically connected to the anode 376 of a direct current power supply 375. A plurality of anode rods 294 made from the plating material are mounted on the anode frame assembly 212, 512 in electrically conductive contact with it. A cathode assembly 360, 540 is electrically connected to the part 100 and is electrically connected to a cathode 378 of the direct current power supply 375. A fluid conduit assembly 440 connects a fluid source such as a pump station 436 to a plurality of fluid nozzles 416, 450, 452, etc. At least one of the fluid nozzles 416 is positioned within an interior cavity 105 of the part 100. Having thus described a plating assembly 160 generally, further details of the plating assembly will now be described.

Figure 2:
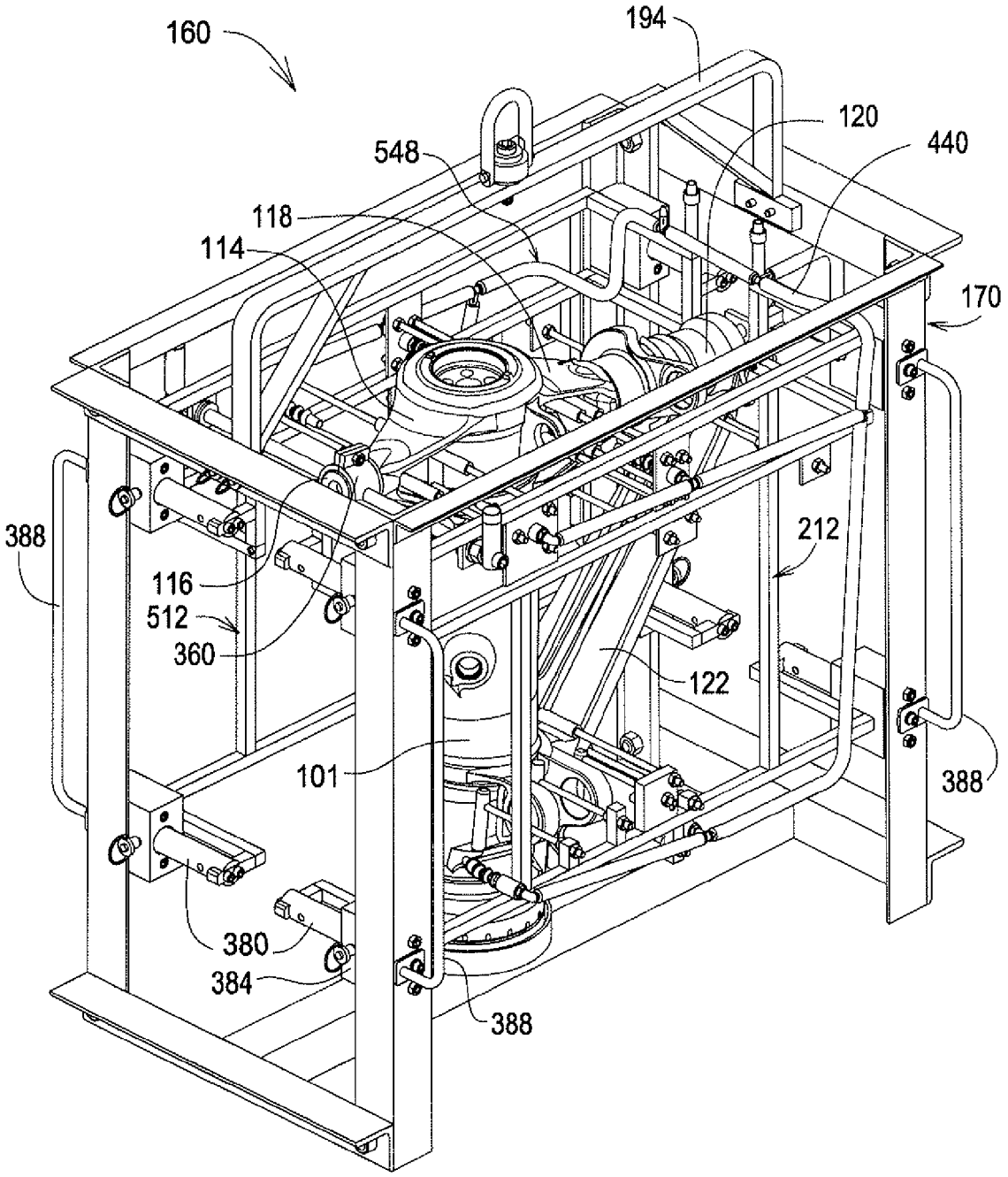
FIG. 2 is a left side isometric view of the cylinder assembly and plating assembly of FIG. 1.
Figure 3:
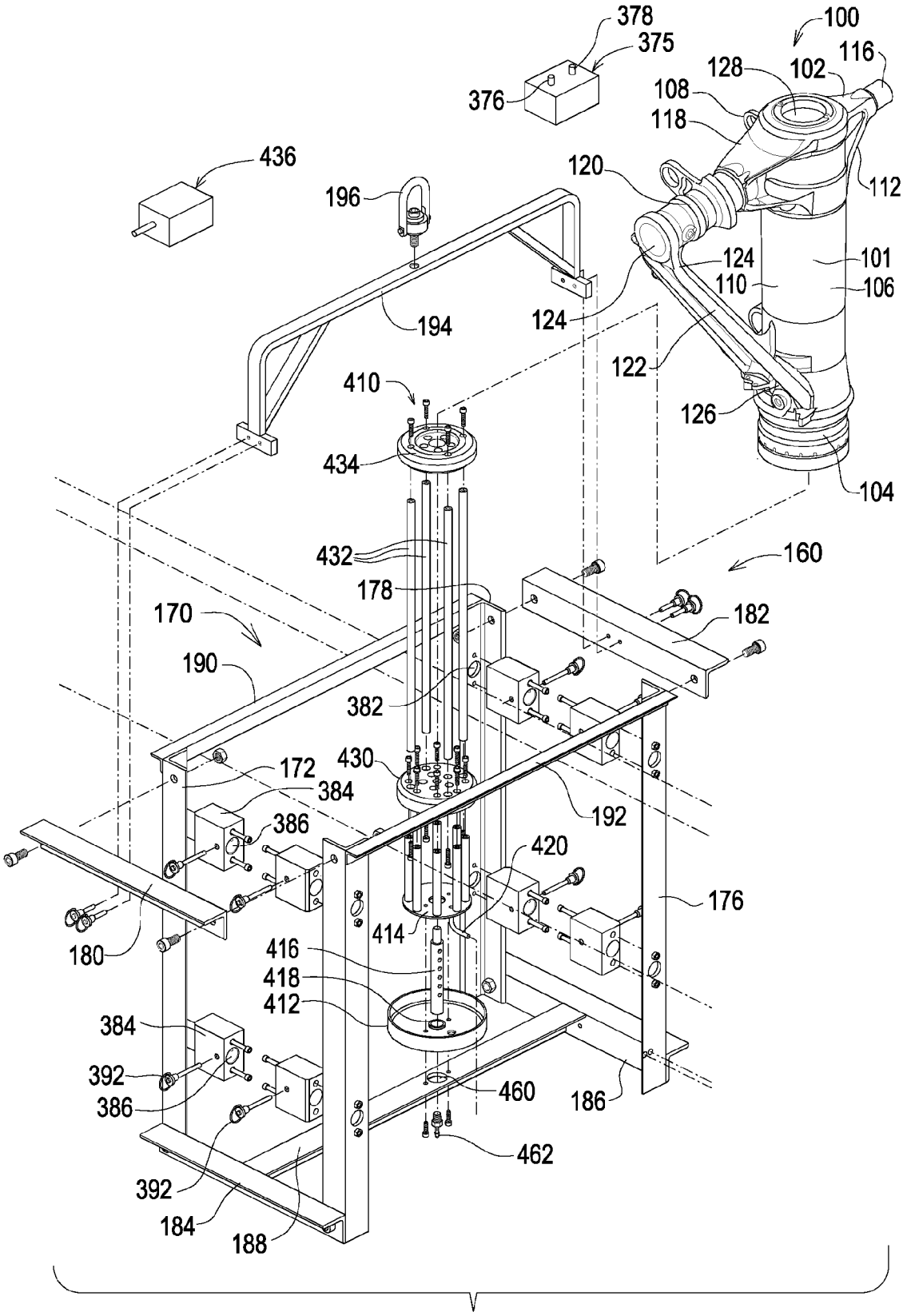
FIG. 3 is an exploded isometric view of the cylinder assembly and a portion of the plating assembly of FIGS. 1 and 2.
Figure 4:
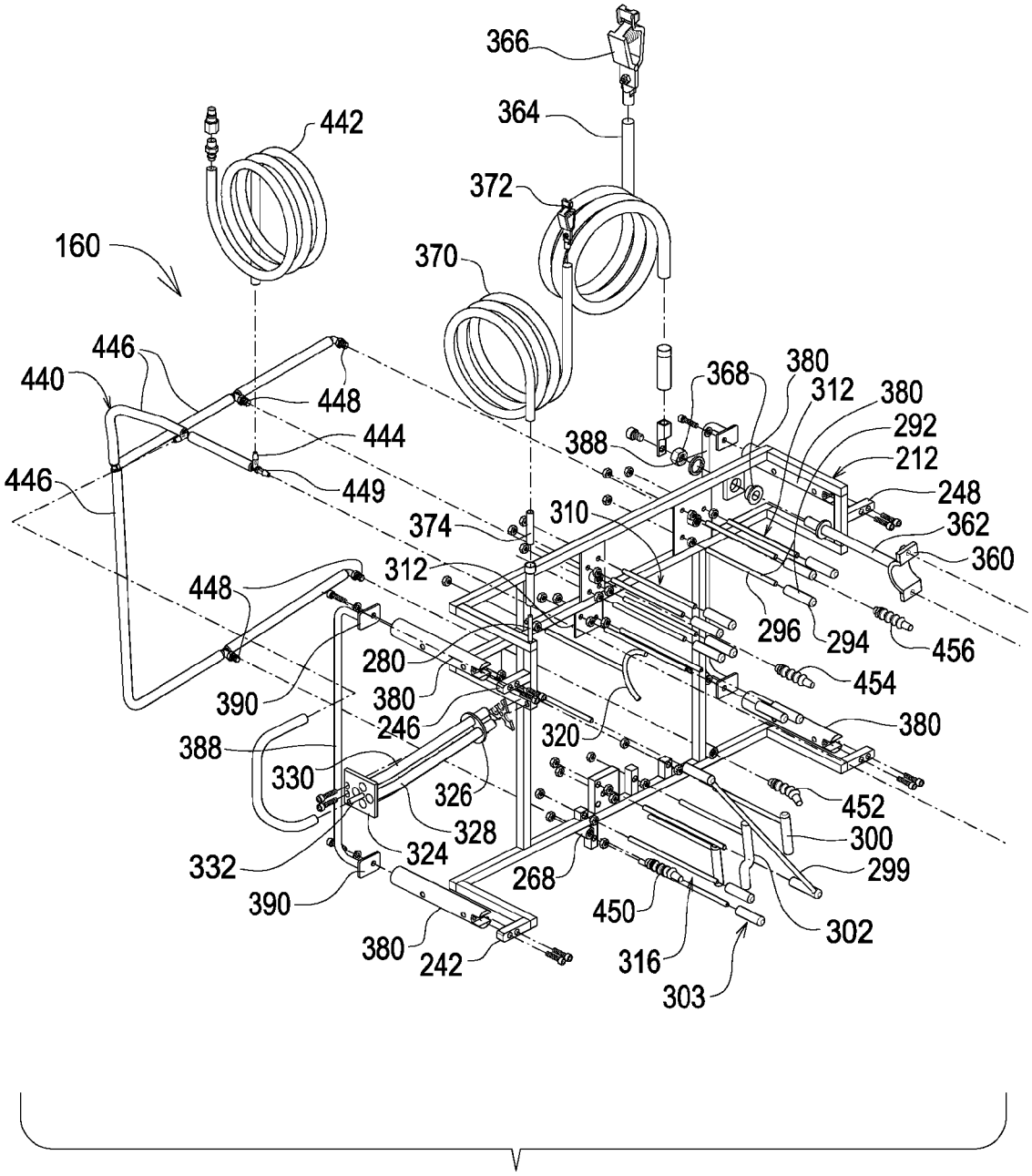
FIG. 4 is an exploded isometric view of a first (left side) anode frame assembly and first (left side) flow conduit assembly of the plating assembly of FIGS. 1 and 2.
Figure 5:
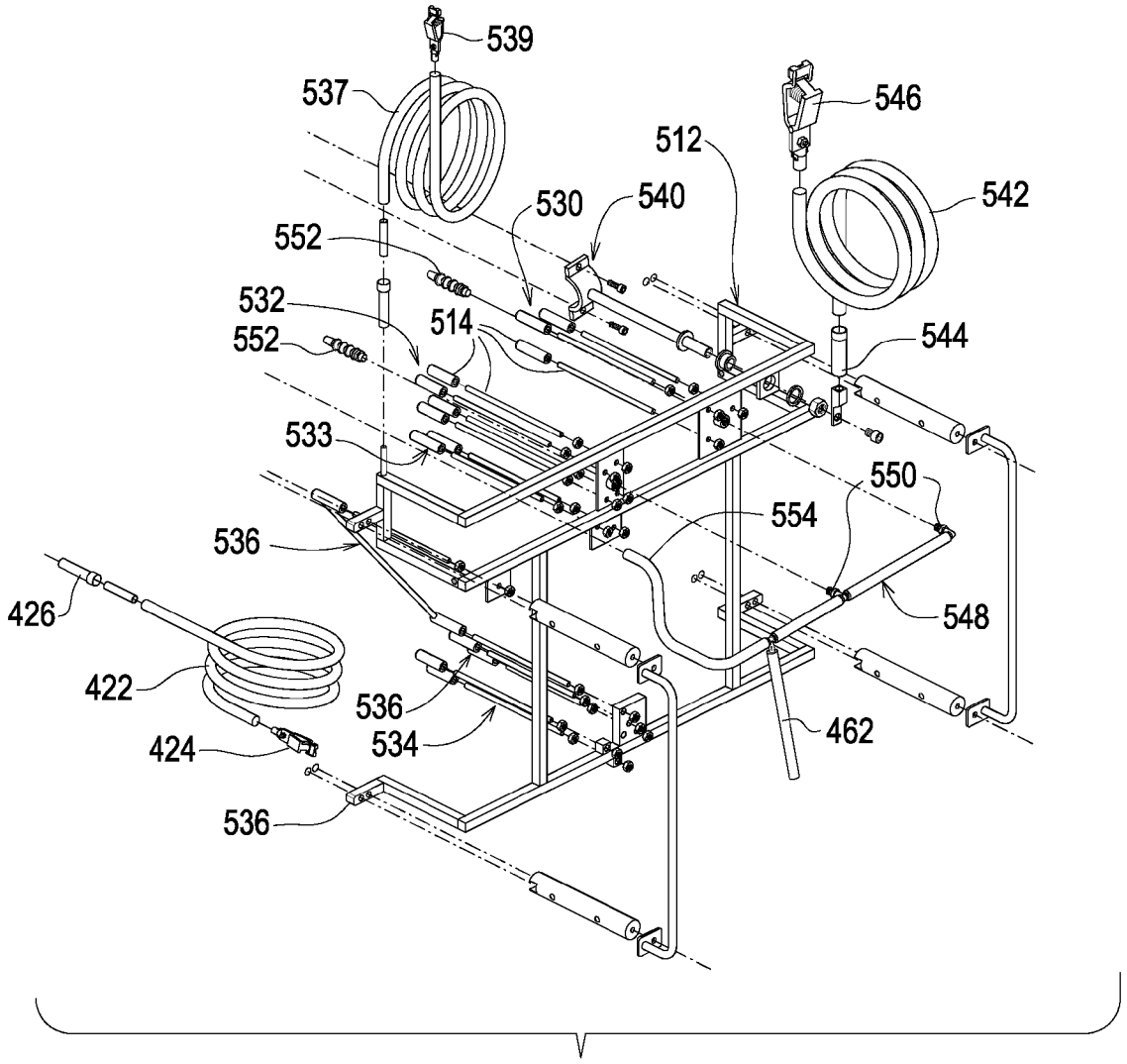
FIG. 5 is an exploded isometric view of a second (right side) anode frame assembly and second (right side) flow conduit assembly of the plating assembly of FIGS. 1 and 2.

FIGS. 3, 4 and 5 are the center, left side, and right side portions of an exploded, isometric drawing of a plating assembly 100 used to plate a cylinder assembly 100 of an aircraft main landing gear right hand side. FIGS. 3-5, because they are exploded views, show many of the details of the plating assembly 160 better than the assembled views of FIGS. 1 and 2. In FIGS. 1 and 2 many reference numerals have been left out to avoid unnecessary clutter.

Figure 10:
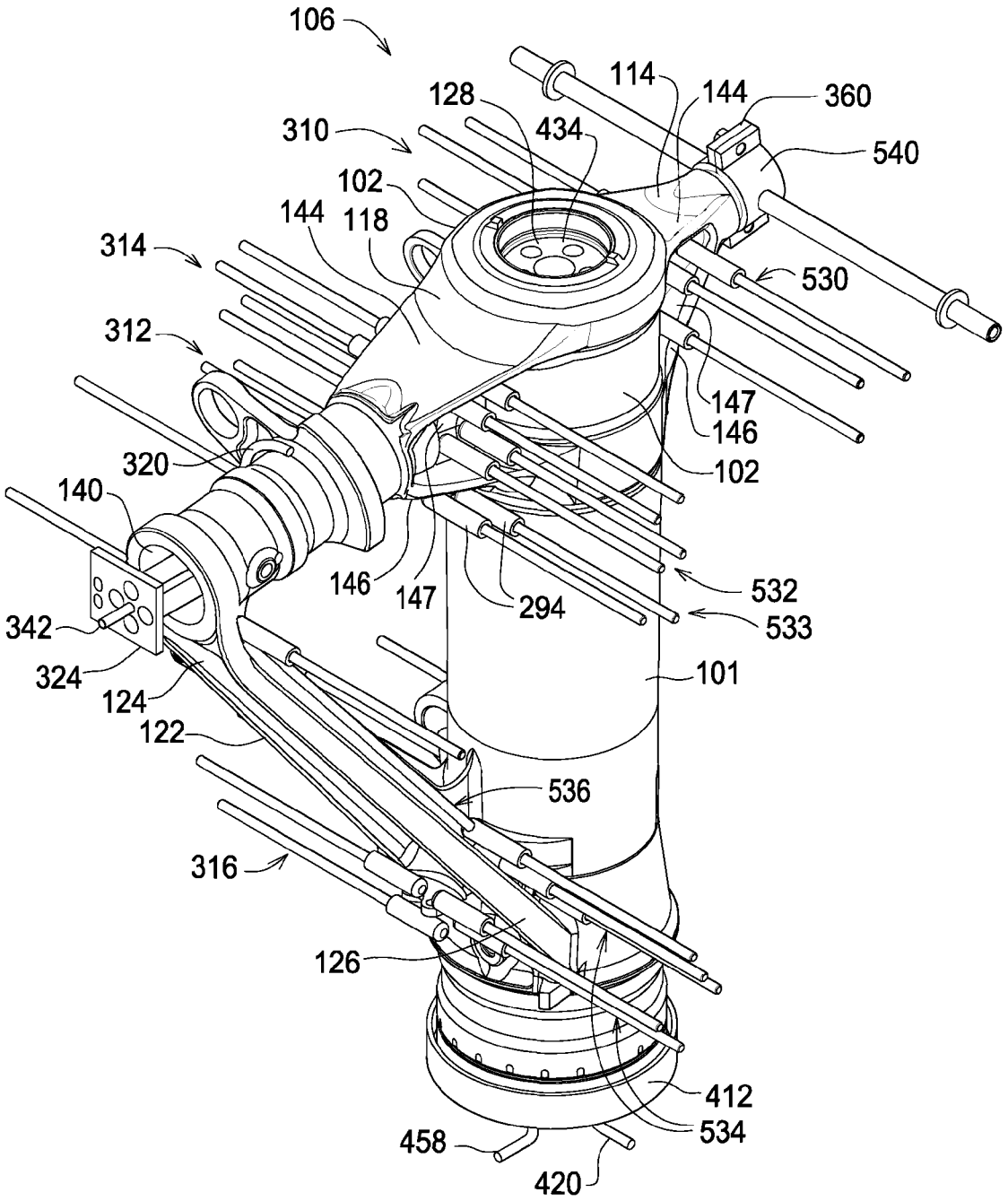
FIG. 10 is an isometric view of a forward side of the cylinder of FIG. 3 showing the position of anode rods with respect to the cylinder.
Figure 11:
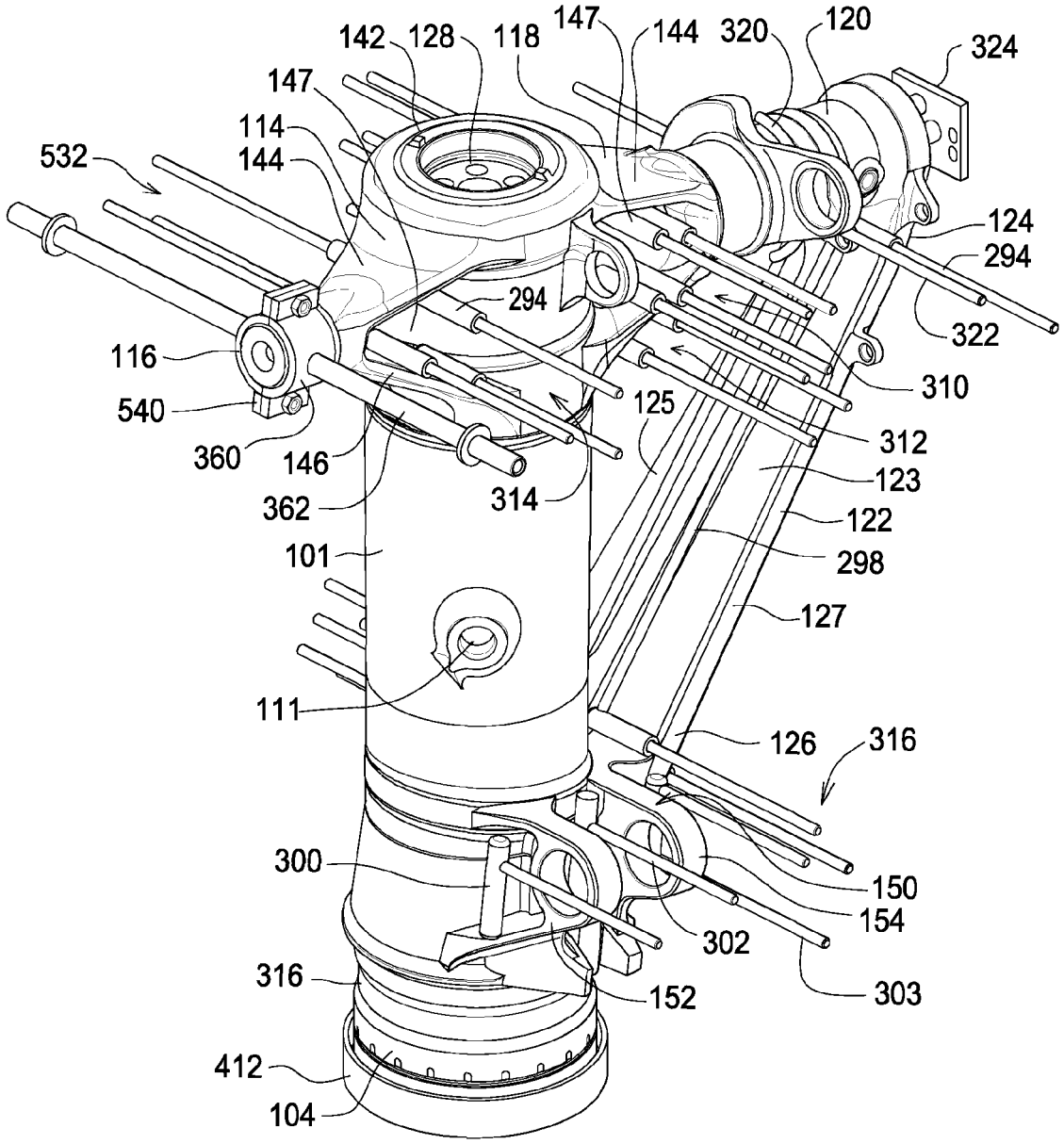
FIG. 11 is an isometric view of a rear side of the cylinder of FIG. 3 showing the position of anode rods with respect to the cylinder.
Figure 12:
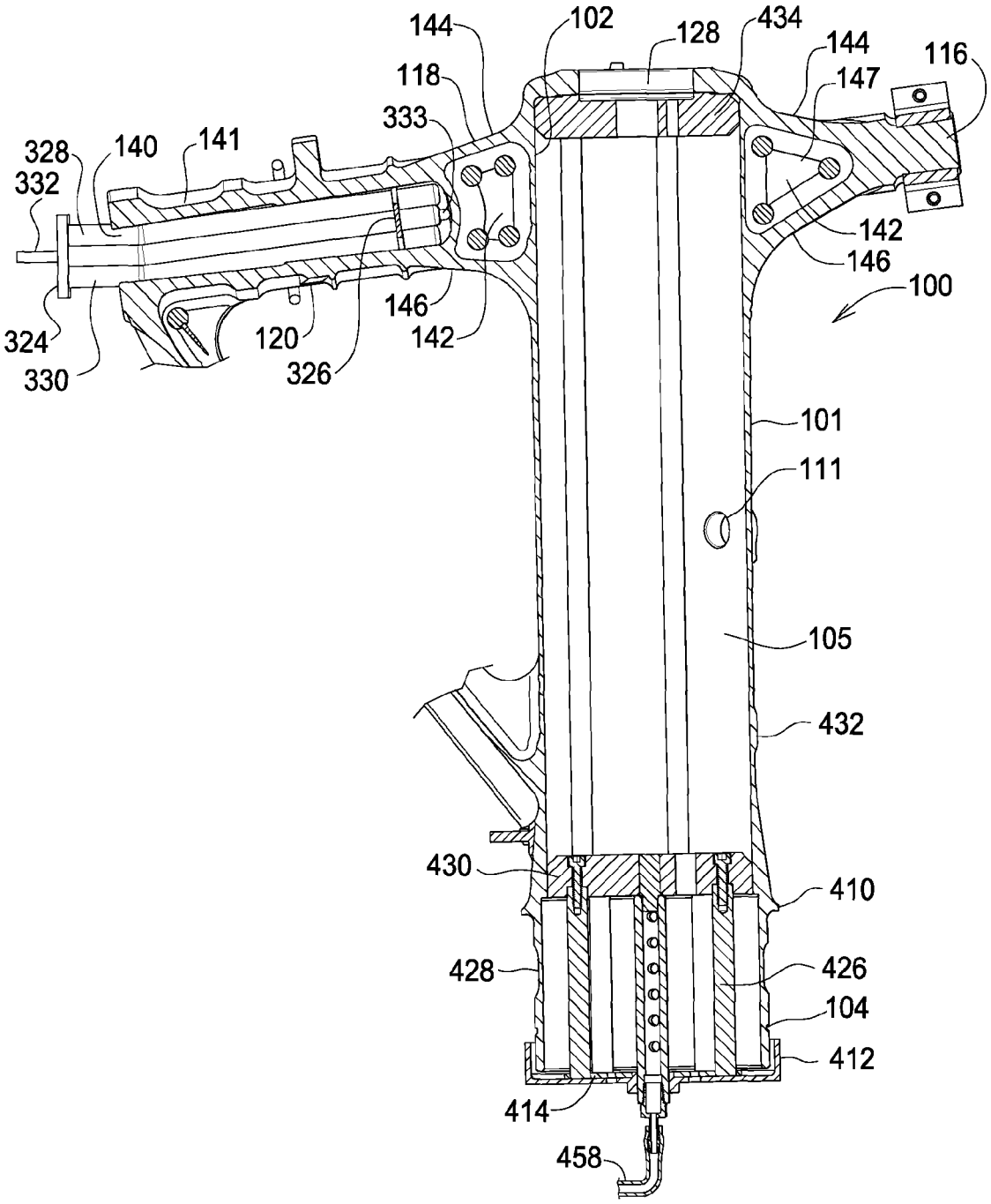
FIG. 12 is a cross sectional elevation view of the cylinder of FIG. 3 showing the position of interior anode rods in the cylinder cavities.

The cylinder assembly 100 may be made from 300 m. The cylinder assembly 100, as illustrated in FIG. 3 and also in FIGS. 10-12, includes a generally cylindrical body 101 having a top portion 102, a bottom portion 104 and a cylindrical interior cavity 105. The cylindrical body 101 has a forward or front side 106, an aft or rear side 108, an outboard side 110, and an inboard side 112. A hole 111 extends through the cylindrical body 101 to the interior cavity 105 and is located near the midpoint of the cylindrical body 101 on the inboard side. The cylindrical body 101 has a top opening 128 which opens into the cylindrical interior cavity 105, as best shown in FIGS. 10-12. The cylindrical body portion 101 may have an outer diameter of about 5.5 in and an inner diameter of about 5.3 in and may have a length of about 23 in.

An inboard trunnion member 114 extends laterally outwardly from the top portion 102 of the cylinder assembly 100. The inboard trunnion member 114 has a post 116 extending from its distal end. An outboard trunnion member 118 is positioned opposite the inboard trunnion member 114. The outboard trunnion member 118 has a trunnion lug 120 mounted at its distal end. An elongated side brace 122 is connected at a first end 124 to the trunnion lug 120 and is connected at a second end 126 to the bottom portion 104 of the cylindrical body 101. The distance between the first end 124 and second end 126 of the brace 122 may be about 13 inches. As best shown in FIG. 11, the side brace 122 may have a generally U-shaped cross section with a central body portion 123 and upwardly extending flanges 125, 127, which may each have a height of about 1.5 inches and which may be integrally formed with the central body portion 123, FIG. 11. The central body portion 123 of the side brace 122 may have a maximum width of about 0.750 inches. As best shown in FIGS. 10 and 12, an opening 140 is provided at the distal end of the trunnion lug 120 and extends into a generally cylindrical interior cavity 141 in the trunnion lug 120. The interior cavity 141 may have an internal diameter of about 2.25 inches, and may have a length of about 8.5 inches. Each of the trunnion members 114, 118 have a vertically disposed central body portion 142, a horizontally disposed top plate portion 144 and a horizontally disposed bottom plate portion 146 at their proximal ends. The central body portion 142 and two horizontal plate portions define recessed, generally triangular shaped portions 147 on each lateral side of each trunnion member 114, 118. As best shown in FIG. 11, the cylinder assembly 100 includes an aft projecting yoke assembly (also referred to herein as the lower side brace lug assembly) 150, which includes spaced apart first and second yoke collar members 152, 154 having aligned holes therein. The members 152, 154 may be spaced apart about 2 in.

As best shown by FIGS. 1-3, the plating assembly 160 includes a generally box shaped main frame assembly 170 which may be constructed from stainless steel members having an angular, e.g., right angle, cross section. The frame members may include vertical corner post members 172, 174, 176, 178, which in one embodiment are each about 2 ft high. The frame assembly 170 further includes lateral cross members 180, 182, 184, 186, a bottom longitudinal cross member 188 and top longitudinal cross members 190 and 192 all of which may have a length of about 2 ft. A removable handle assembly 194 may be attached to lateral cross members 180 and 182. The handle assembly 194 may be provided with a central ring assembly 196 to facilitate lifting of the plating assembly 160, as with a hoist mechanism (not shown). The handle assembly may be removed to facilitate mounting of the cylinder assembly 100 within the frame assembly 170.

Figure 6:
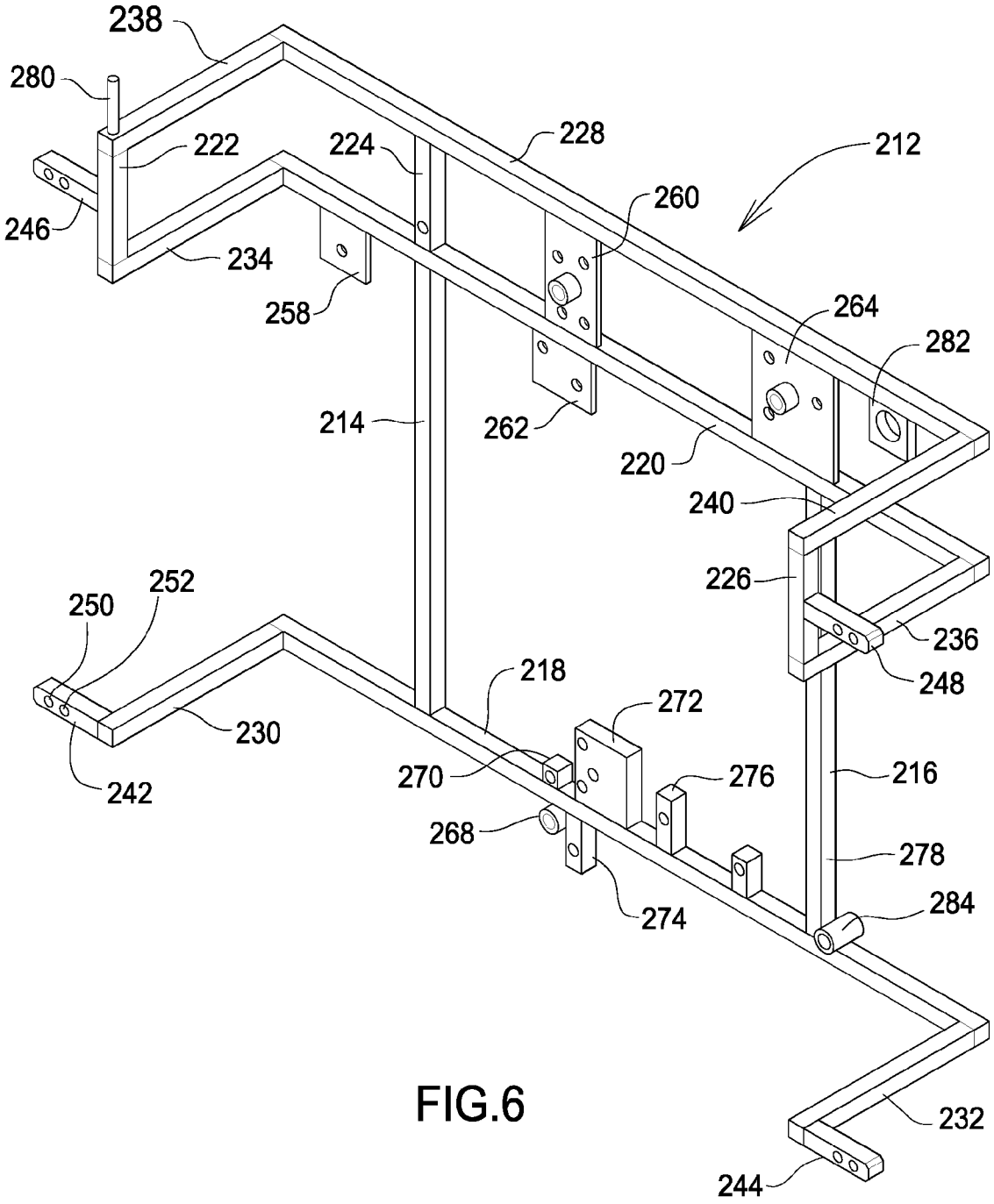
FIG. 6 is an isometric view of a first (left side) anode frame portion of the anode frame assembly of FIG. 4.

FIGS. 4, 6, 7 and 8 illustrate a left anode frame 212. The anode frame 212 may include two longer vertical members 214, 216 which are attached at opposite ends thereof to a lower longitudinal member 218 and a middle longitudinal member 220. Shorter vertical members 222, 224, 226 may be mounted on the middle longitudinal member 220. An upper longitudinal member 228 is attached to the upper ends of the shorter vertical members 222, 224, 226. A pair of lower lateral members 230, 232 extend laterally inwardly from opposite ends of the lower longitudinal member 218 as best shown by FIG. 6. Middle lateral members 234, 236 and upper lateral members 238, 240 project inwardly from end portions of the middle and upper longitudinal members 220, 228, respectively. Longitudinally extending connection members 242, 244, 246, 248 which may have screw holes 250, 252 or the like therein are connected to vertical members 222 and 226 and lateral projecting members 230, 232, respectively. Upper anode plates 258, 260, 262 and 264 are connected to one or both of the middle and upper longitudinal members 220, 228. Lower anode plates 268, 270, 272, 274, 276, 278 are connected to the lower longitudinal member 218. A vertically extending pin 280 is provided on upper lateral member 238 in alignment with shorter vertical member 222. A trunnion collar support plate 282 is attached to the upper longitudinal member 228. A nozzle support cylinder 284 is mounted at the junction of longer vertical member 216 and lower longitudinal member 218.

Figure 8:
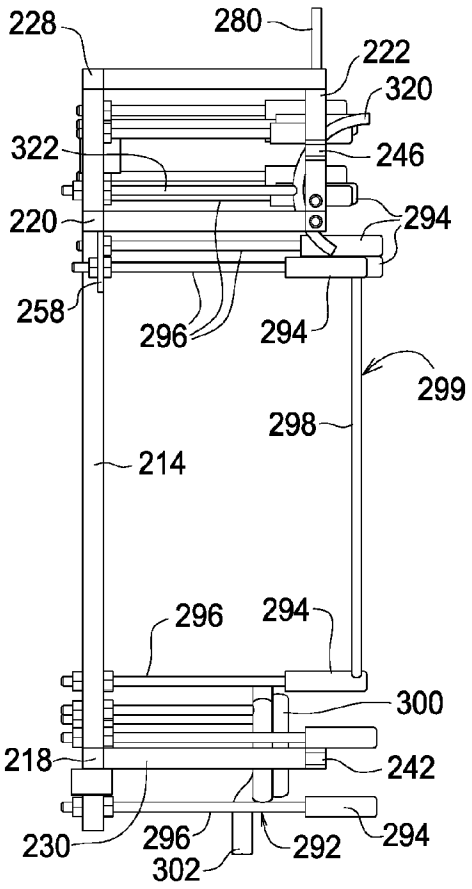
FIG. 8 is a front elevation view of the first (left side) anode frame assembly of FIG. 4.
Figure 9:
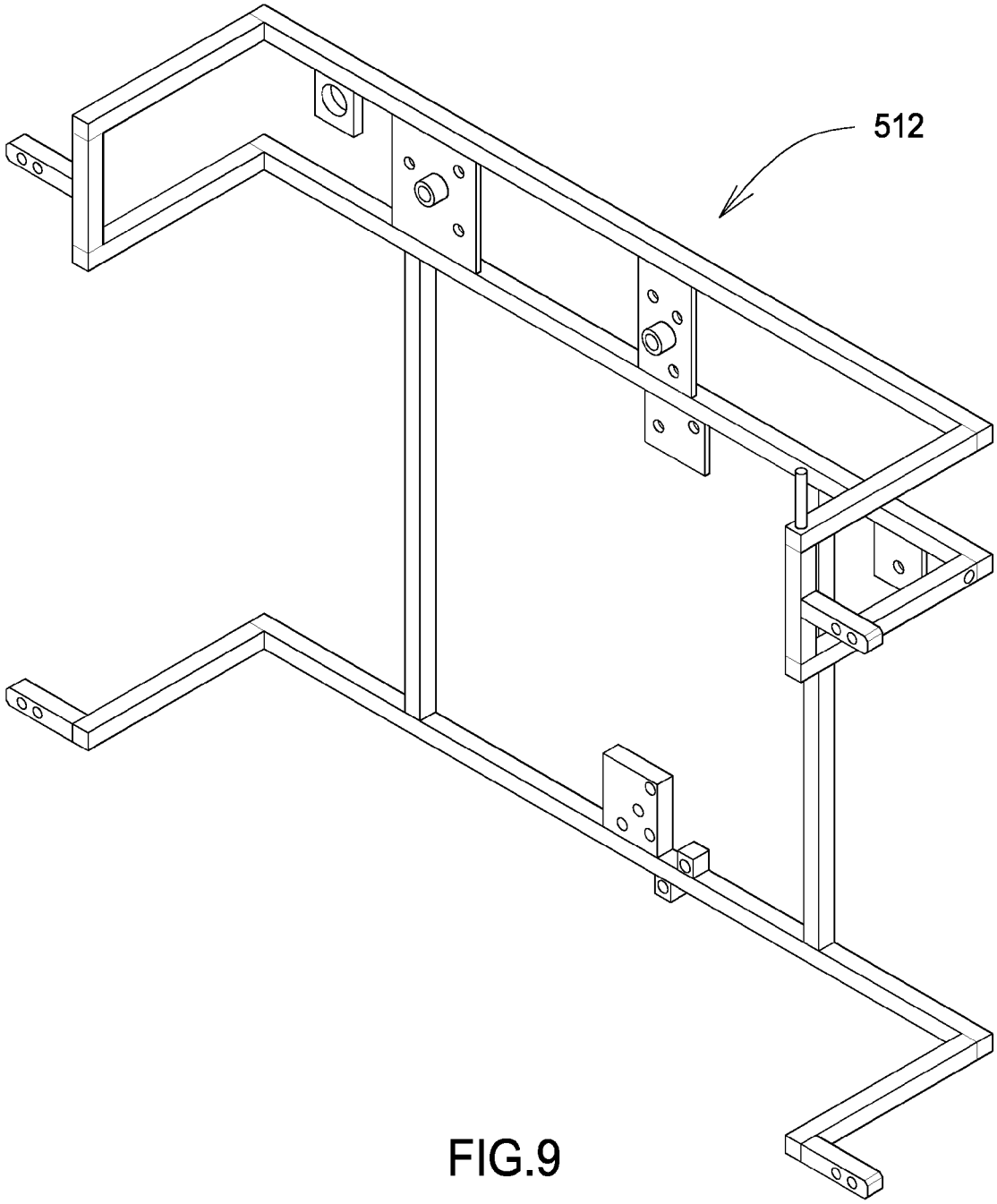
FIG. 9 is an isometric view of a second (right side) anode frame portion of the second anode frame assembly of FIG. 5.

A plurality of left side anode rod/extender assemblies 292 are mounted on the left anode frame 212 by the various anode plates. As best shown by FIG. 8, each anode rod/extender assembly 292 includes a laterally extending anode rod 294, which in one case comprises number 200 nickel that in one embodiment is ½ inch in diameter by 2¼ inches long. Each assembly 292 also includes an anode extender shaft or simply "extender" 294 which in one embodiment is constructed from stainless steel having a diameter of ¼inch which may be of various different lengths but which are most typically 5¼ inch in length. Also mounted on the anode frame is an anode bridge assembly 299, which may include an anode bridge rod 298, which may be constructed from the plating material, e.g., nickel, and which may have a diameter of ¼inch and a length of 12¾ inch. Other types of anode assemblies include downwardly extending anode T-rods 300 and lug anode rods 302. In the illustrated embodiment, the anode assemblies 292 are arranged on the left anode frame in various clusters including a first cluster 310 mounted on plate 260 which includes four anode assemblies 292; a second cluster 312 mounted on plate 262 which includes two anode assemblies; a third cluster 314 mounted on plate 264 which includes three anode assemblies. A fourth cluster 316 mounted on supports 268, 270, 272, 274, 276, 278 and 284 and which includes eight anode assemblies. An arcuate anode member 320 may be supported in an anode bore 321 by extender bar 322. A trunnion hole anode base plate 324 may be mounted on the left anode frame 212. A pair of trunnion hole anode rods 328, 330 are mounted at one end trunnion hole anode plate 324 and are attached at opposite ends thereof to end plate 326. A trunnion hole flow conduit connection 332 may also be provided on the trunnion hole anode plate 324 and is attached to a nozzle flow tube 333 that extends between the trunnion hole anodes 328, 330, as best shown in FIG. 12.

A trunnion engaging cathode collar portion 360 is mounted on an extender rod 362 which may, in turn, be mounted on trunnion collar support plate 282 in electrical isolation therefrom. The cathode collar extender rod 362 is electrically connected to cathode cable 364 which may have alligator clamps 366 at one end thereof and a cathode cable end connector assembly 368 at the other end thereof, FIG. 4. The cathode cable alligator clamps 366 may be connected to the cathode 378 of a direct current power source 375, FIG. 3. An anode cable 370 may have an alligator clip 372 at one end thereof for connecting the anode cable to the anode 376 of a DC power source. The anode cable has an end connector assembly 374 which is adapted to connect the anode cable to pin 280 on the left anode frame 212 as shown in FIG. 4. The current produced by the DC power source may be about 575 amps. The various anode rods 294 are adapted to be positioned in close proximity, e.g., 0.25 inches from, adjacent portions of the cylinder assembly 100. The various anode rod clusters 310, 312, etc., are adapted to be positioned next to portions of the cylinder assembly 100 that are most in need of plating or that are in areas that are hard to coat.

As shown in FIGS. 1, 2 and 4, four slider rods 380 may be attached at one end thereof to respective ones of longitudinally extending connector members 242, 244, 246, 248. The opposite ends of the slider rods 380 are attached to handle members 388 at end plate portions 390 thereof. In one embodiment, the handles 388 are made from stainless steel and the slider rods 380 are made from molybdenum disulfide (MDS) filled Nylon. The handle members 388 are slidingly received in holes 382 in the vertical members 172, 174, 176, 178. The handle members 388 are also slidingly received in holes 386 of slider isolation blocks 384 that may be made from nylon. The blocks are attached to the vertical members 172, 174, 176, 178. The holes in the blocks are aligned with holes in the vertical members. Thumb screws 392 or the like may be provided in the isolation blocks 384 and may be used to hold the slider rods 380 at a desired lateral location. Thus the left anode frame 212 which is connected to the slider rods 380 may be positioned at a desired lateral distance from the cylinder assembly 100 by grasping the handles 388 and moving them laterally in the desired direction. This assembly also allows the anode frame 212 to be moved laterally outwardly to provide clearance when the cylinder assembly is being mounted on the main frame 170. This manner of mounting the left anode frame 212 on the main frame 170 electrically isolates the anode frame 212 from the main frame assembly 170.

As shown in FIGS. 3, 5 and 12, a first interior anode assembly 410 may be supported on a nonconductive end cap shield 412, which is in turn mounted on bottom longitudinal cross member 188 of the main frame assembly 170. The longitudinal cross member 188 has a central hole 460 therein and the cap shield is attached to the cross member 188 as by screws 462. This first interior anode assembly 410 includes an anode base plate 414 supported on the end cap shield 412. The base plate 414 may be made from nickel. A lower anode lead 420, FIGS. 1 and 8, extends through a small hole in the end cap 412 and is connected to anode cable 422 by connector assembly 426, FIG. 5, with the opposite end of the cable being connected as by alligator clamp 424 to DC power source anode 376, FIG. 5. The lower anode lead 420 is electrically connected to anode base plate 414. Eight vertical anode rods 428, as best shown in FIG. 3, are mounted on the anode base plate 414 in electrical contact therewith. The vertical anode rods 428 may be made from nickel and in one embodiment have a diameter of ½ inch and a height of 5 inches. The upper ends of the vertical anode rods 428 may be connected, as by nylon screws, to an upper support plate 430 which is adapted to slidingly engage the interior wall of the cylinder body 101. Support plate 430 is made from an insulating material such as CPVC plastic. The end cap shield 412 and the support plate 430 electrically isolate the first interior anode assembly 410 from the cylinder assembly 100. A plurality, e.g., four, of vertical support and spacer rods 432 are attached at their lower ends to support plate 430 and at their upper ends to upper cap member 434 which may also be constructed from CPVC plastic. A Nickel 200 flow tube 416 having a plurality of openings therein extends through and above a hole 418 in the end cap 412. The flow tube 416 passes through another hole in the anode base plate 414 and is attached at its upper end to support plate 430. The vertical anode rods 428 are arranged in a circle around the flow tube 416. The flow tube may have a height above the anode plate 414 of about 7 in.

As best shown by FIG. 5, a left side flow conduit assembly 440 may be supported by left side anode frame 212. The flow conduit assembly may include a supply hose 442 which is attached at one end to a fluid forcing source such as a pump 436. The other end of the supply hose 442 is connected as by a connecting stub 444 to a fluid conduit 446 having multiple branches. The fluid conduit 446 may be, for example, polyurethane tubing having an inner diameter of ¼ inch and an outer diameter of ½ inch. The conduit 446 may have a plurality of connector stubs 448 which are attached to various nozzle assemblies, 450, 452, 454, 456 that are supported on the left anode frame 212. Each of these nozzles 450, 452, etc., may be associated with a different one of the anode clusters 310, 312, 314, etc. One conduit branch 458, FIG. 10, is connected to flow tube 416 associated with the first interior anode assembly 410, FIG. 12. The fluid flow rate through the supply hose 442 may be between about 1 and 3 gal/min.

Figure 7:
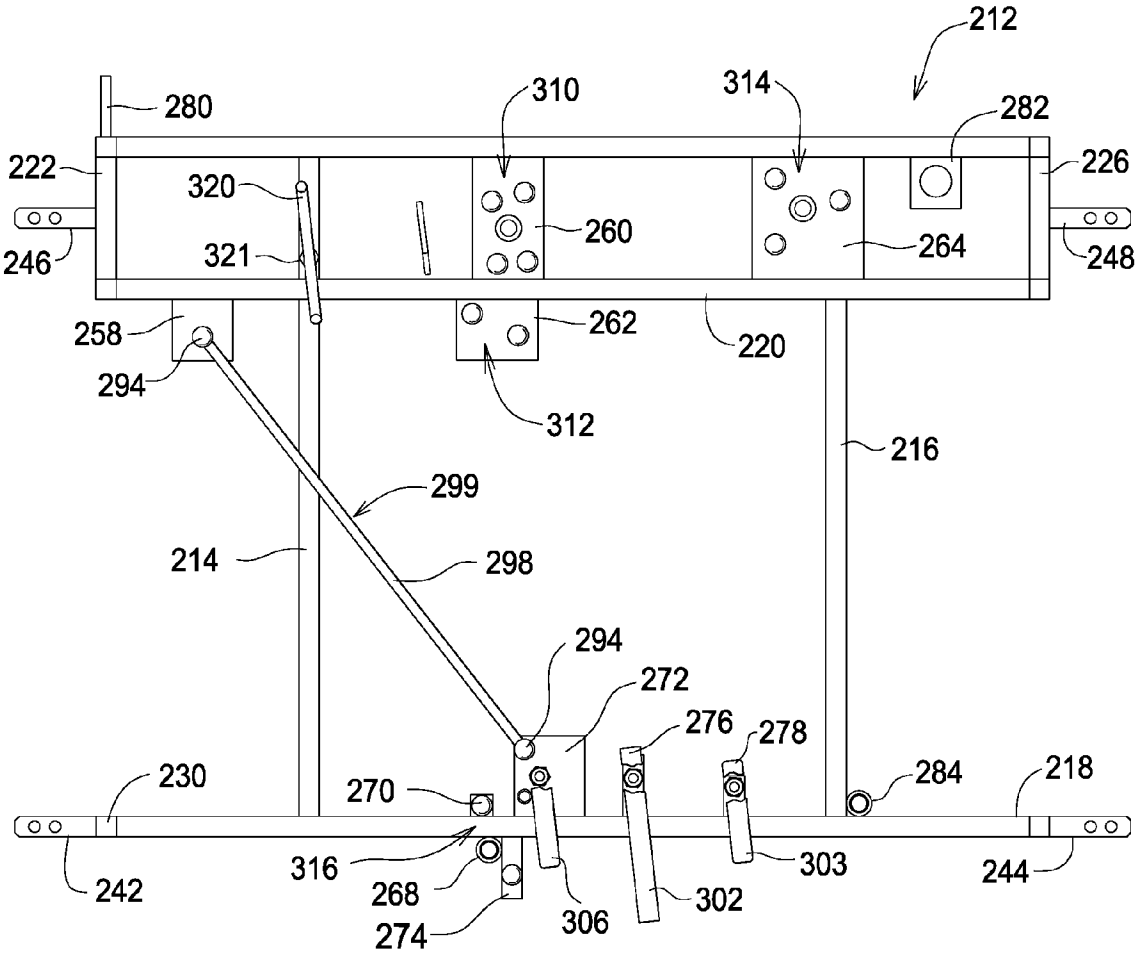
FIG. 7 is a side elevation view of the first (left side) anode frame assembly of FIG. 4.

A right anode frame 512 is best illustrated in FIGS. 5 and 7. As may be seen from FIGS. 5 and 7, the construction of the right anode frame 512 may be essentially a mirror image of the left anode frame 212 except for the exact position of certain support plate portions thereof. A plurality of anode rod extender assemblies 514 which may be substantially identical in construction to the anode rod extender assemblies 292 on the left anode frame assembly are supported by the right anode frame 512. The anode rod extender assemblies 514 on the right anode frame may also be arranged in clusters including a first right side cluster 530 of three, a second right side cluster 532 of four, a third cluster 534 of four and a fourth cluster 535 of two. Additionally, an anode bridge assembly 536 including two anode rod assemblies which are connected to opposite ends of a bridge rod is also provided. An anode cable 537 may have an alligator clamp 539 connecting it at one end to DC power source anode 376. The opposite end of the anode cable 537 is connected to the right anode frame 512.

A trunnion cathode collar assembly 540, which may be a mirror image of the left side collar assembly 360, is adapted to be connected to the left side collar assembly to secure the collar assembly about the trunnion post 116, as best shown in FIG. 5 and FIG. 11. A cathode cable 542 has a connector assembly 544 at one end thereof which is attached in electrical contact with the trunnion cathode collar assembly 540. The opposite end of the cathode cable 542 may have an alligator clamp 546 or the like which is attached to the cathode 378 of the direct current power supply 375. A right side fluid flow conduit assembly 548 may be supported on the right anode frame 512 in a manner substantially similar to that as described above with respect to the left flow conduit assembly 440. The flow conduit assembly 548 comprises a plurality of nozzle connector studs 550 and nozzles 552 associated with the various anode clusters 530, 532, 534, 535.

Having thus described the structure of one embodiment of a plating assembly, the operation of the plating assembly 160 will now be described. To begin with the cylinder assembly 100 is placed in the support frame 170. This may be accomplished by first removing the handle assembly 194 and upper cross members 180, 182. Also, the anode frames 212, 512 are moved laterally outwardly by pulling outwardly on handles 388. The cylinder assembly 100 is then lowered into position onto the bottom longitudinal cross member 188 and around the interior anode assembly 410. Next the anode frames are moved laterally inwardly as to a position where the handle members 388 come into abutting engagement with the support frame 170. The cylinder assembly 100 may then be connected, as at trunnion post 116 to cathode collar 360, 540. The cathode collar 360, 540 mechanically stabilizes the cylinder assembly 100 within the support frame and also enables electrical connection of the cylinder assembly to the cathode 378 of the associated DC power supply 375. The handle assembly 194 and cross members 180, 182 may then be remounted on the support frame 170. The support frame 170 is then lowered into an electrolyte bath (not shown) as by a hoist mechanism attached to ring member 196. The electrolyte bath is sufficiently deep to cover the entire support frame and cylinder assembly 100. The supply hose 442 of the conduit assemblies 440, 548 may then be connected to electrolyte pump 436. The anode cable 372 may be connected, as by alligator clamp 372, to the anode 376 of the power supply 375 and the cathode cable 542 may be connected, as by alligator clamp 546, to cathode 378. The DC power source 375 and the pump 436 may then be switched on to commence the plating of the cylinder assembly 100.

It will be understood from the above that a method of plating a part 100 may include mounting a first and second anode frame 212, 512 on a support frame 170 in electrical isolation from the support frame 170. The part 100 is also mounted on the support frame 170 in electrical isolation from it. The method also includes mounting anode rods 294 made from the plating material on the first and second anode frames 212, 512 in a plurality of anode clusters 310, 312, etc. The anode clusters are positioned adjacent to selected surfaces of low current density regions, e.g., 124, 126, 147 and interior regions, e.g. 105, 141 of the part 100. The first and second anode frames 211, 512 are connected to the anode 376 of a direct current power supply 375. The part 100 is connected to the cathode 378 of the direct current power supply 375. The support frame 170 is submerged in an electrolyte bath. The direct current power supply 170 is activated to commence plating of the part 100. The plating method may also include circulating the electrolyte around and through the part 100 by directing fluid nozzles 333, etc., which are connected to a fluid pumping station 436 and associated with anode assembly clusters 310, 312, 314, toward various portions of the part 100.

Although certain embodiments of a plating assembly and plating methods have been described in detail herein, it is to be understood that the plating assembly and method are not limited to these specific embodiments and may be otherwise constructed and performed. Many alternative embodiments will be apparent to those skilled in the art after reading this disclosure. It is intended that the appended claims be construed to encompass such alternative embodiments, except to the extent limited by the prior art.

What is claimed is:

1. A plating assembly for plating an aircraft landing gear cylinder assembly wherein said aircraft landing gear cylinder assembly comprises a hollow, generally cylindrical body having a top portion, a bottom portion, a forward portion, an aft portion, an outboard portion and an inboard portion, and a vertically extending, cylindrical cavity having a bottom opening and a top opening, the cylinder assembly further comprising an inboard extending trunnion member and an outboard extending trunnion member mounted on said top portion of said cylindrical body, a trunnion lug mounted on said outboard extending trunnion member, a brace having an upper end and a lower end, said upper end of said brace being mounted on said trunnion lug, said lower end of said brace being mount on an outboard portion of said bottom portion of said cylindrical body, said trunnion lug having a laterally extending lug cavity with an outboard opening, said plating assembly comprising:

a generally box shaped main frame assembly adapted to receive and support said aircraft landing gear cylinder assembly therein;

a first side anode frame mounted on said main frame assembly and laterally slidingly displaceable with respect to said main frame assembly, said first side anode frame being electrically conductive and connected to an anode of a direct current power supply;

a second side anode frame mounted on said main frame assembly and laterally slidingly displaceable with respect to said main frame assembly, said second side anode frame being electrically conductive and electrically connected to said anode of said direct current power supply;

a plurality of exterior anode assemblies supported on said first and second side anode frames and projecting laterally inwardly from said anode frames;

a first interior anode assembly positioned inside said vertical cylindrical cavity;

a second interior anode assembly positioned inside said laterally extending lug cavity;

a cathode assembly electrically isolatingly mounted on at least one of said anode frames, electrically connected to a cathode of said direct current power supply and mechanically and electrically connected with said cylinder assembly;

a conduit assembly supported by at least one of said first and second side anode frames and comprising a plurality of conduit branches in fluid communication with a plurality of fluid nozzles.

2. The plating assembly of claim 1 wherein said exterior anode assemblies each comprise:

a conductive bar having a first end attached to one of said anode frames and a second end; and an anode rod made of plating material mounted on said second end of said conductive bar.

3. The plating assembly of claim 2, further comprising a first elongate anode bridge member connected to two anode rods attached to upper and lower portions of said first side anode frame, said first elongate anode bridge member being positioned parallel to and adjacent said brace of said cylinder assembly and extending substantially from said upper end to said lower end of said brace.

4. The plating assembly of claim 3, further comprising a second elongate anode bridge member connected to two anode rods attached to upper and lower portions of said second side anode frame, said second elongate anode bridge member being positioned parallel to and adjacent said brace of said cylinder assembly and extending substantially from said upper end to said lower end of said brace.

5. The plating assembly of claim 2 wherein said exterior anode assemblies are arranged in a plurality of closely grouped anode assembly clusters.

6. The plating assembly of claim 5 wherein at least one laterally inwardly directed fluid nozzle is positioned adjacent at least one of said plurality of closely grouped anode assembly clusters.

7. The plating assembly of claim 1 wherein at least one of said fluid nozzles is associated with each of said first and second interior anode assemblies.

8. The plating assembly of claim 7 wherein said main frame assembly comprises a lower frame member adapted to electrically isolatingly support said cylinder assembly thereon, wherein said first interior anode assembly comprises a bottom anode plate constructed from said plating material and a plurality of vertical anode rods made from said plating material and attached to said anode plate, said anode plate being electrically connected to said anode of said direct current power supply.

9. The plating assembly of claim 8, wherein said at least one fluid nozzle associated with said first interior anode assembly comprises a vertical conduit with a plurality of orifices therein.

10. The plating assembly of claim 8 wherein said trunnion members comprise a plurality of recessed portions wherein one of said plurality of closely grouped anode assembly clusters is positioned in each of said plurality of recessed portions.

11. The plating assembly of claim 10 wherein said brace and said cylindrical body define a generally V-shaped region where said second end of said brace is connected to said cylindrical body and wherein at least one of said plurality of closely grouped anode assembly clusters is positioned in said V-shaped region.

12. The plating assembly of claim 11 wherein at least one of said plurality of closely grouped anode assembly clusters is positioned adjacent to said brace lower end on a side of said brace opposite from said V-shaped region.

* * * * *